US005946825A

United States Patent [19]

Koh et al.

[11] Patent Number: 5,946,825

[45] Date of Patent: Sep. 7, 1999

[54] FOOTWEAR HAVING SLOW RECOVERY LINER

[75] Inventors: Kanae H. Koh, Venice, Calif.; John F. Ludemann, Cincinnati, Ohio

[73] Assignee: Nine West Group, Inc., White Plains, N.Y.

[21] Appl. No.: 08/792,873

[22] Filed: Jan. 31, 1997

[51] Int. Cl.[6] ..... A43B 13/40; A43B 19/00; A43B 23/07

[52] U.S. Cl. ..... 36/44; 36/55; 36/37

[58] Field of Search ..... 36/88, 71, 43, 36/44, 55, 54, 72 R, 37

[56] References Cited

U.S. PATENT DOCUMENTS

| | | | |
|---|---|---|---|
| D. 336,977 | 7/1993 | Sensi . | |
| D. 356,673 | 3/1995 | Gerhartl . | |
| D. 364,034 | 11/1995 | Lee et al. . | |
| 2,413,534 | 12/1946 | Watson | 36/43 |
| 3,414,988 | 12/1968 | Mattos . | |
| 3,589,037 | 6/1971 | Gallagher . | |
| 3,825,017 | 7/1974 | Scrima | 36/44 |
| 4,054,706 | 10/1977 | Shapiro | 36/44 |
| 4,187,621 | 2/1980 | Cohen | 36/44 |
| 4,345,387 | 8/1982 | Daswick | 36/43 |
| 4,346,205 | 8/1982 | Hiles . | |
| 4,541,184 | 9/1985 | Leighton . | |
| 4,541,186 | 9/1985 | Mulvihill . | |
| 4,586,273 | 5/1986 | Chapnick | 36/37 |
| 4,627,179 | 12/1986 | McElroy . | |
| 4,635,385 | 1/1987 | Ogden . | |
| 4,642,912 | 2/1987 | Wildman et al. . | |
| 4,685,224 | 8/1987 | Anger . | |
| 4,719,247 | 1/1988 | Lin et al. . | |
| 4,782,605 | 11/1988 | Chapnick . | |
| 4,808,469 | 2/1989 | Hiles . | |
| 4,931,773 | 6/1990 | Rosen | 36/43 |
| 5,014,041 | 5/1991 | Rosen | 36/43 |
| 5,015,427 | 5/1991 | Sosnow | 36/71 |
| 5,050,319 | 9/1991 | Perotto et al. | 36/55 |
| 5,542,196 | 8/1996 | Kantro . | |

FOREIGN PATENT DOCUMENTS

| | | | |
|---|---|---|---|
| 384008 | 8/1990 | European Pat. Off. | 36/37 |
| 0388661 A1 | 9/1990 | European Pat. Off. . | |
| 427556 | 5/1991 | European Pat. Off. | 36/44 |
| 591909 | 4/1994 | European Pat. Off. | 36/88 |
| 1078403 | 8/1967 | United Kingdom . | |
| 1285673 | 8/1972 | United Kingdom . | |

*Primary Examiner*—Paul T. Sewell
*Assistant Examiner*—Anthony Stashick
*Attorney, Agent, or Firm*—Senniger, Powers, Leavitt & Roedel

[57] ABSTRACT

A cushion for use inside footwear having an interior for receiving a foot of a wearer. The cushion includes a liner made of cushioning material. The liner is sized and shaped for reception on an interior surface of the footwear in a position for engaging the foot when the foot is inserted into the interior of the footwear for cushioning an interface between the foot and the interior surface of the footwear with which the liner is engaged. The liner includes a visual cushioning indicator for visually indicating the operability of the cushion to perform a cushioning function during an immediately prior use by the wearer and for subsequent use.

12 Claims, 5 Drawing Sheets

20
66
62
58
24
56
22
86
96
80
30
60
32

122
120
118
114
6
50

118
112
122
114
110

FOOTWEAR HAVING SLOW RECOVERY LINER

BACKGROUND OF THE INVENTION

This invention relates generally to footwear, and in particular to a liner for cushioning a foot inside the footwear wherein the liner visually indicates whether the liner is effectively cushioning the foot during use.

When walking or running, the heel of the foot generally strikes the ground first during each gait cycle. The foot then pivots on the heel until the lateral (outside) part of the forefoot contacts the ground. At this point, the foot rolls inward to a supinated position, and then rapidly outward to a neutral position in which the bottom of the heel and the metatarsal heads of the forefoot contact the ground. Next, the foot rolls from the neutral position back to a supinated position prior to the propulsive phase of the gait cycle. During the propulsive phase of the gait cycle, the foot pivots upward on the forefoot as the toes push off the ground to propel the foot forward and assist the corresponding leg in pulling the foot toward the next step.

In view of the foregoing, it will be observed that various parts of the foot impact the sole of footwear during various portions of each gait cycle. To cushion the foot, the soles and sockliners of footwear are frequently made of compliant materials. Further, to enable the upper to conform to the foot, compliant materials are frequently used inside the uppers of footwear and these materials also help to cushion the foot from impacts. However, over time and through use, the compliant materials gradually lose their resilience so they have a reduced ability to protect against impact and to conform to the foot. When this happens, the footwear and/or the removable liners must be replaced to avoid injury to the foot due to impact or improper fit.

SUMMARY OF THE INVENTION

Among the several objects and features of the present invention may be noted the provision of footwear which visually indicates whether it is effectively cushioning the foot during use; the provision of footwear which indicates whether the footwear needs replacement; and the provision of footwear which is lightweight and comfortable to wear.

Briefly, apparatus of this invention is a cushion for use inside footwear having an interior for receiving a foot of a wearer. The cushion comprises a liner made of cushioning material. The liner is sized and shaped for reception on an interior surface of the footwear in a position for engaging the foot when the foot is inserted into the interior of the footwear for cushioning an interface between the foot and the interior surface of the footwear with which the liner is engaged. The liner includes a visual cushioning indicator for visually indicating the operability of the cushion to perform a cushioning function during an immediately prior use by the wearer and for subsequent use.

In another aspect, the invention is a cushion for use inside footwear to provide cushioning to a foot received within the footwear. The cushion comprises a layer made of compliant slow recovery foam having an initial thickness prior to use and a compressed thickness thinner than the initial thickness during use resulting from pressure applied to the cushion by the foot. The foam has a resiliency capable of restoring the cushion substantially to the initial thickness after the foot is withdrawn from the footwear and pressure is relieved from the cushion. The resiliency of the foam is selected to restore the cushion to the initial thickness sufficiently slowly that the foot may be withdrawn from the footwear and the cushion may be visually inspected before the resiliency fully restores the cushion to the initial thickness. Thus, the resiliency provides a visual indication that the cushion effectively cushioned the foot during prior use and is capable of effectively cushioning the foot during future use.

In yet another aspect, the invention is footwear comprising a sole having an upper surface adapted to receive a foot and an upper attached to the sole for overlying at least a portion of the foot as the foot is received on the sole. The sole and upper define an interior for receiving a foot of a wearer. The footwear also includes a cushion comprising a liner made of cushioning material positioned in the interior of the footwear on an interior surface of one of the sole and the upper. The liner includes a visual cushioning indicator for visually indicating the operability of the cushion to perform a cushioning function during an immediately prior use by the wearer and for subsequent use.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
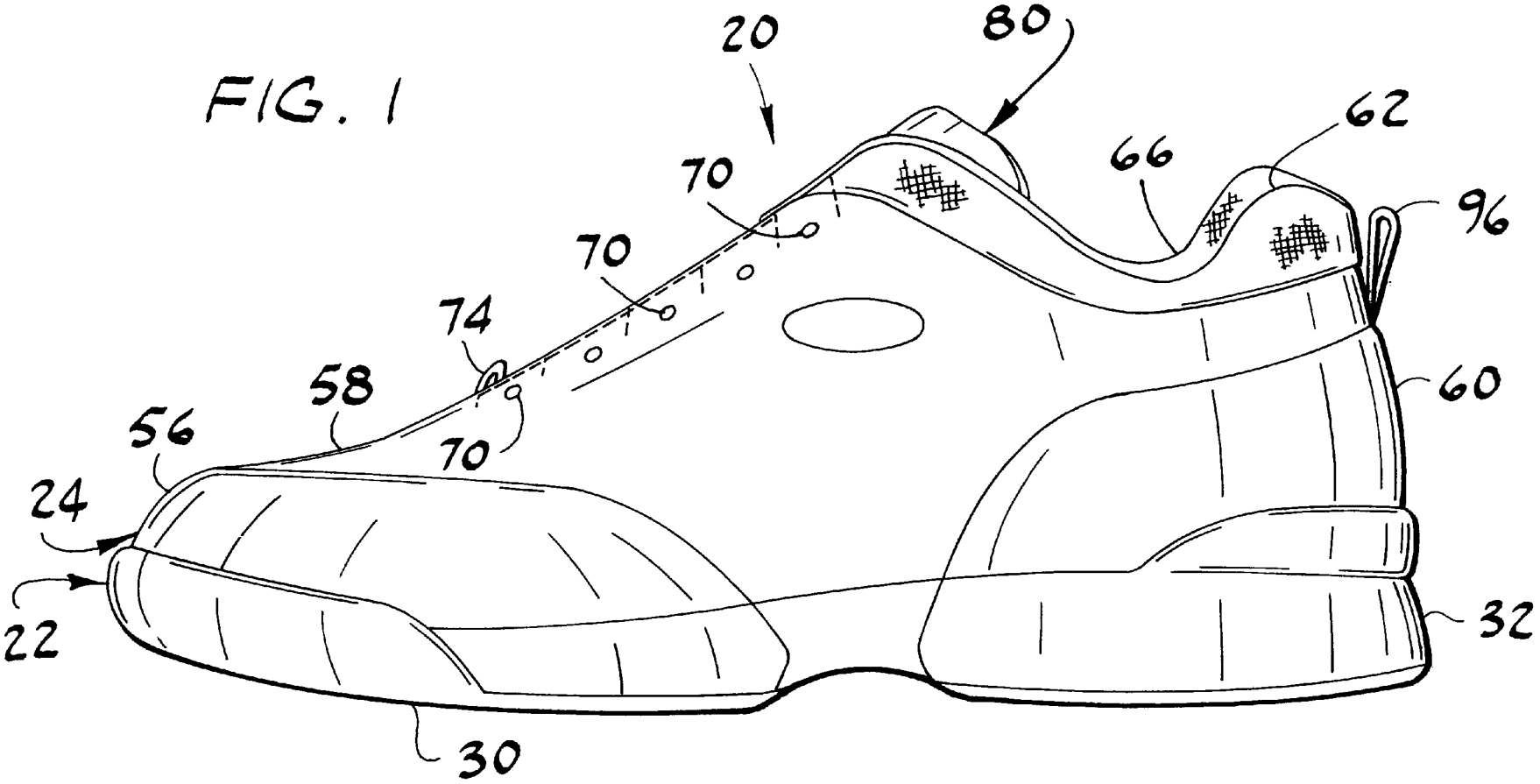
FIG. 1 is a side elevation of footwear of the present invention.

Referring now to the drawings and in particular to FIG. 1, footwear, indicated generally at 20, is of the type worn by persons to exercise. The footwear 20 shown in FIG. 1 is an athletic shoe of the type particularly suited for walking activities. Although the present invention will be described with reference to this type of footwear, it should be understood this invention is also applicable to other types of footwear including dress shoes, boots, sandals and athletic shoes designed for activities other than walking.

Figure 4:
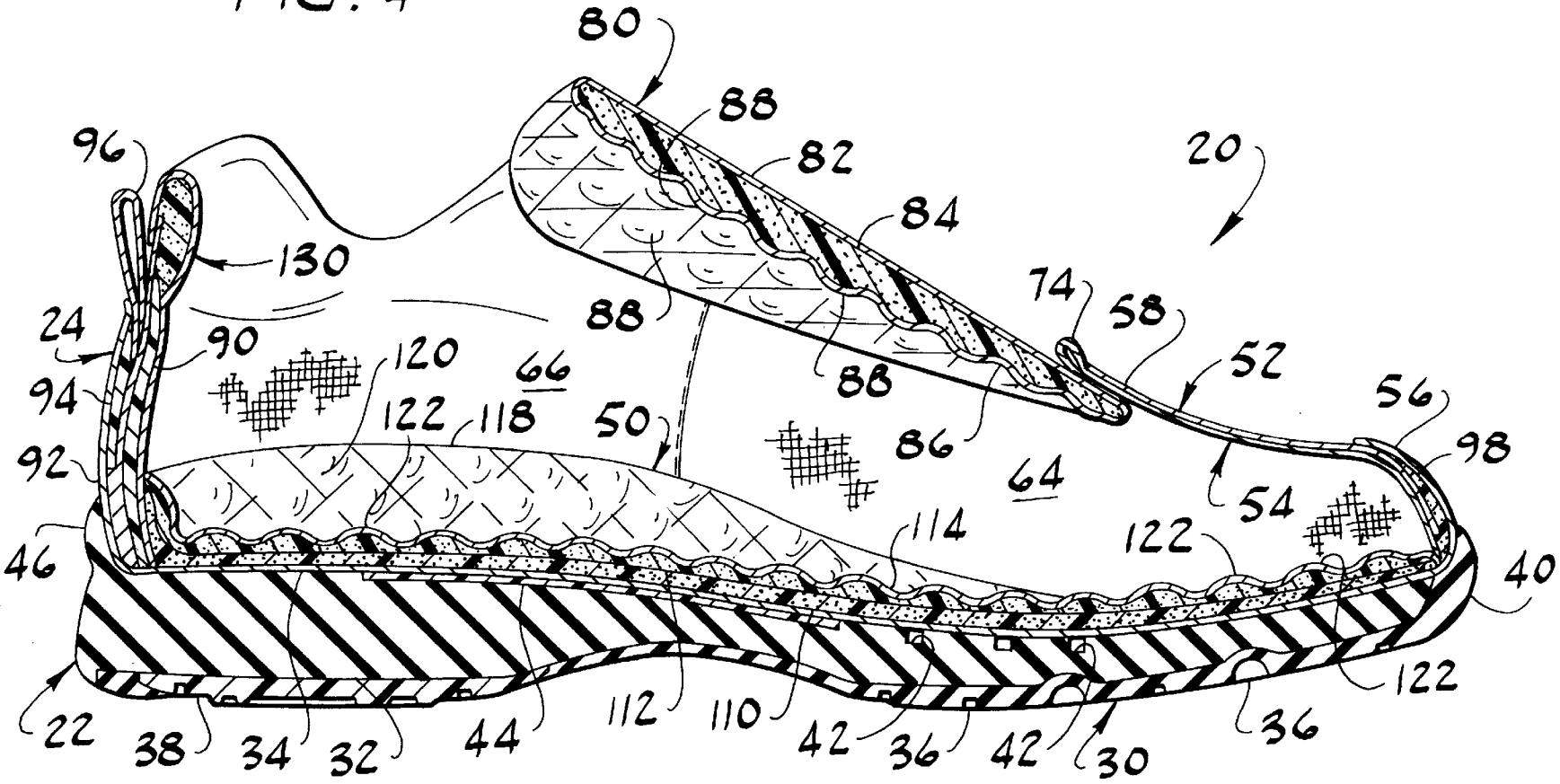
FIG. 4 is a cross section of the footwear taken in the plane of line 4—4 of FIG. 1.

The footwear 20 comprises a sole (generally designated by 22) and an upper (generally designated by 24), each of which have an overall size and shape similar to corresponding portions of the wearer's foot. As illustrated in FIG. 4, the sole 22 comprises three layers, an outsole (generally designated by 30), a midsole (generally designated by 32) and an insole liner 34, which are adhesively bonded together. The outsole 30 is made of synthetic rubber and has a tread 36 on its bottom surface which forms the bottom the shoe for providing traction when contacting the ground. A generally translucent, synthetic gum rubber insert 38 is positioned in the heel section of the outsole 30 for ornamenting the bottom of the sole 22, increasing the traction capability of the heel section, and absorbing shock. As further illustrated in FIG. 4, the outsole 30 extends upward in front of the forward end of the midsole 32 and forms a rim 40 around the forward end of the sole 22 to protect the toe section of the upper 24.

The midsole 32, which generally tapers from a thickness of about 2.5 centimeters (cm) at its rearward end to a thickness of about 1 cm at its forward end, is bonded to the upper surface of the outsole 30 using a conventional adhesive. Slots 42 are formed along the top surface of the midsole 32 and extend laterally to enable the sole to bend easily under the metatarsal heads of the wearer's foot as the foot rocks upward on the forefoot during the propulsive phase of the gait cycle. A hard plastic shank 44 is molded into the upper surface of the midsole 32 for supporting the wearer's foot in the midfoot region, particularly during the propulsive phase of the gait. As further illustrated in FIG. 4, the midsole 32 extends upward and forms a rim 46 around the rearward end of the sole 22 to protect the heel section of the upper 24 and improve the bond strength between the upper and sole. The midsole 32 is made of an ethylene-vinyl acetate copolymer (EVA) having a specific gravity of less than about 0.2 and a hardness as measured by a Shore A scale durometer of between 25 and 30. Thus, the midsole 32 is lightweight and absorbs much of the shock caused by the foot hitting the ground during various phases of the gait. Further, the outsole 30 and midsole 32 of the preferred embodiment are made of materials having contrasting colors to improve the aesthetic appeal of the sole 22.

The insole liner 34 is made of a thick fabric and may include a design on its upper surface which forms the inside of the shoe. The outer edge of the insole liner 34 is sewn to the lower edge of the upper 24 before being bonded to the midsole 32 with an adhesive as is conventional in the art. As shown in FIG. 4, a replaceable foam sockliner, generally designated by 50, is received on the upper surface of the insole liner 34 for providing additional cushioning to the wearer's foot as will be explained in greater detail below.

Figure 2:
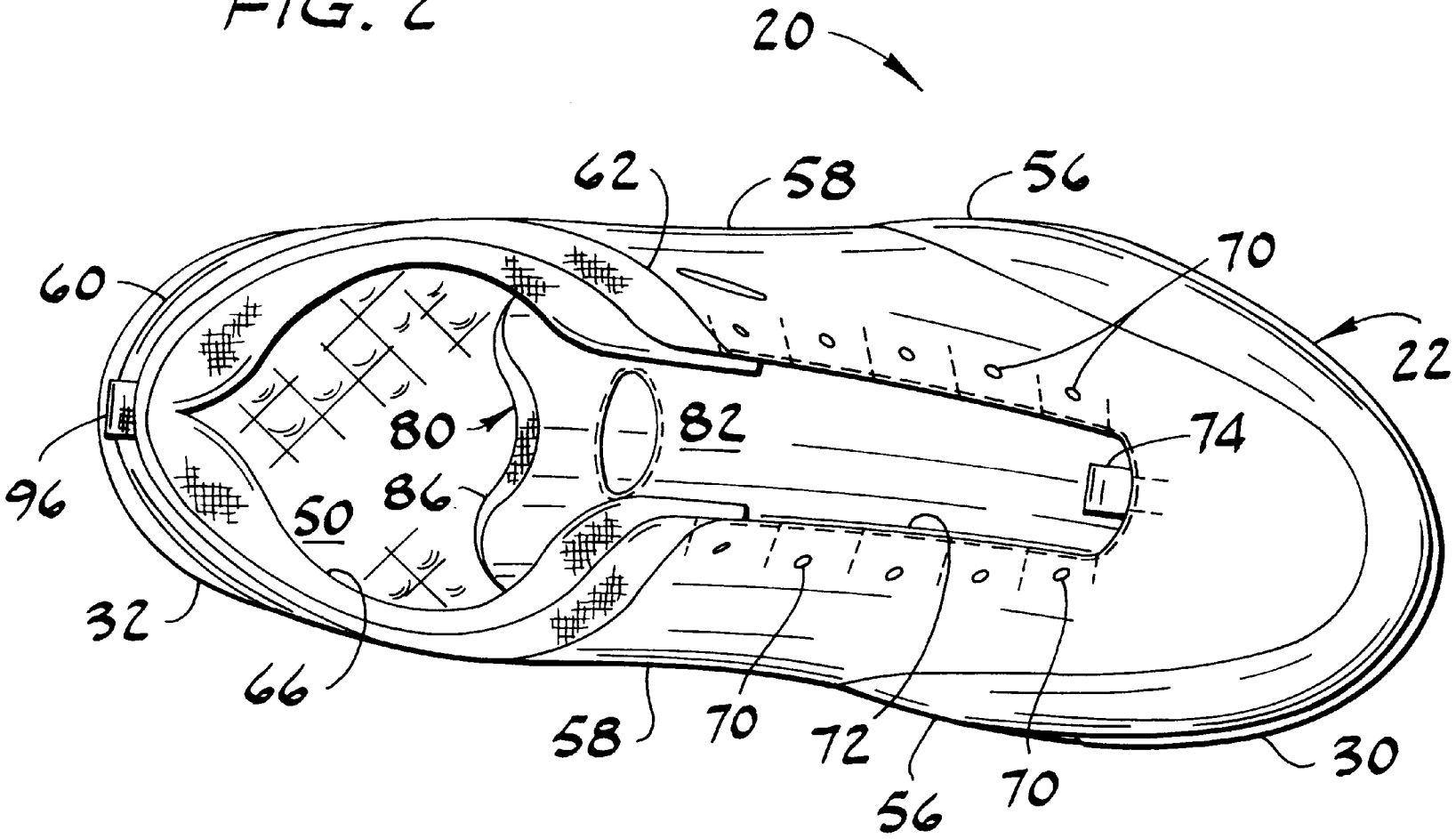
FIG. 2 is a top plan of the footwear.
Figures 3, 5, 6:
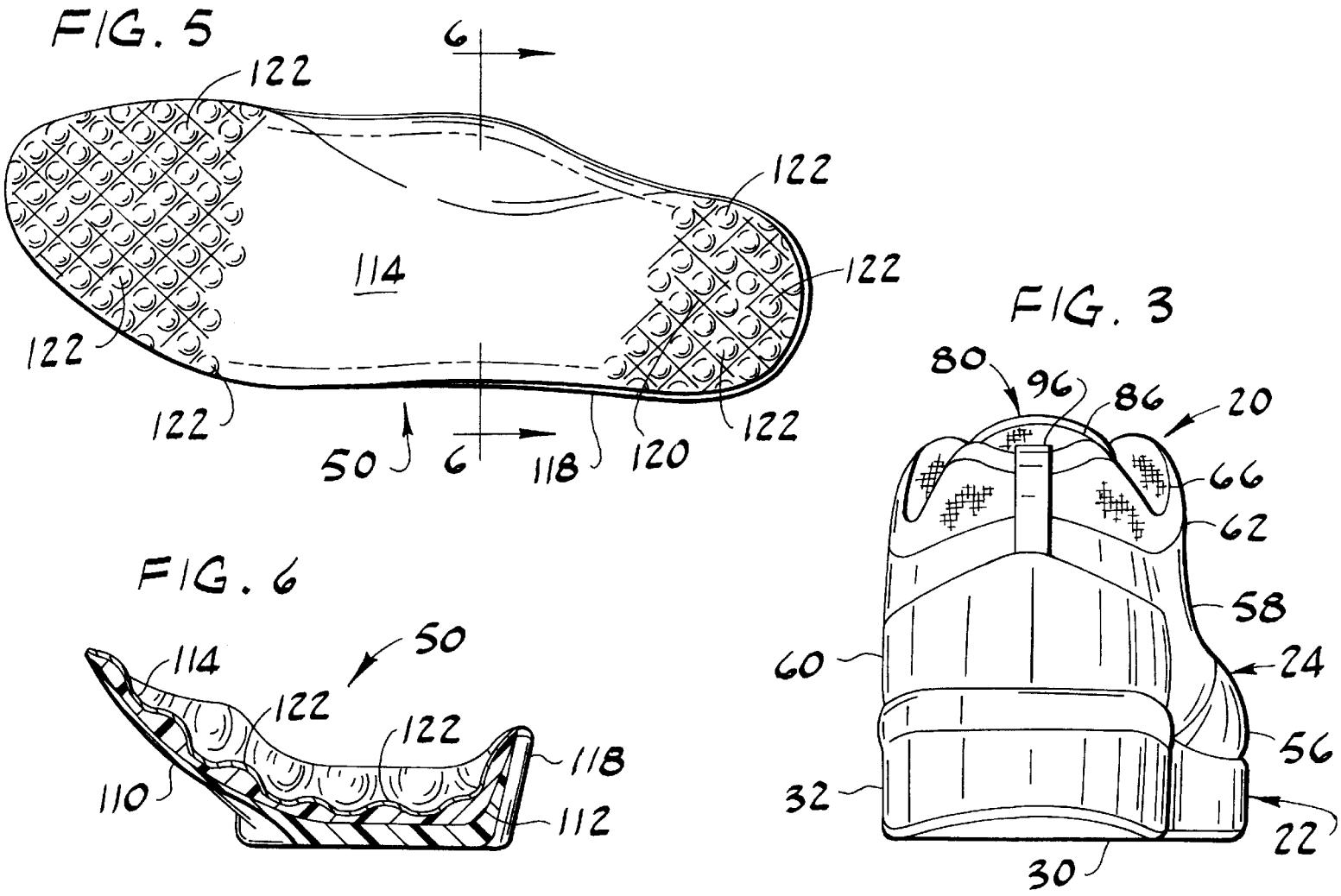
FIG. 3 is a rear elevation of the footwear.
FIG. 5 is a top plan of a sockliner received inside the footwear.
FIG. 6 is a cross section of the sockliner taken in the plane of line 6—6 of FIG. 5.

As further illustrated in FIG. 4, the upper 24 generally includes an outer shell (generally designated by 52), and a fabric liner (generally designated by 54) adhesively bonded inside the outer shell for overlying at least a portion of the foot as the foot is received on the sole 22. As illustrated in FIGS. 1–3, the outer shell 52 comprises a tip 56, a vamp 58, a counter 60, and a collar 62. The tip 56, vamp 58 and counter 60 are each made of leather, and the collar 62 is made of fabric. These components are sewn together along their edge margins in a conventional manner to form the outer shell 52 of the shoe. The liner 54 is formed from a first lining 64 bonded to the forward portion of the outer shell 52 and a second lining 66 having a satin finish overlapping the first lining and bonded inside the heel region of the outer shell. The satin finish of the second lining 66 reduces friction between the wearer's heel and the shoe.

As illustrated in FIG. 2, the vamp 58 is split over the forefoot to enable the collar 62 to be expanded for inserting and removing of the foot. Eyelets 70 are formed on the margins of the vamp 58 adjoining the split 72 for accepting laces (not shown) to tie the shoe on the foot. A thin sheet of felt (not shown) is glued in a conventional manner between the outer shell 52 and fabric liner 54 along the eyestay split 72 to reinforce the eyelets 70 against tearing. Further, a leather loop 74 is sewn at the lower end of the split 72 for further retaining the laces.

A tongue, generally designated by 80, is sewn to the upper 24 at the bottom of the split 72 so it extends upward and rearward under the split. As illustrated in FIG. 4, the tongue 80 is made of three layers of material, an outer layer 82, a middle layer 84 and an inner layer 86. The outer layer 82 is made of leather, the middle layer 84 is made of a foam material and the inner layer 86 is made of cloth having a satin finish similar to the lining 66 in the heel region of the upper 24. The foam used in the middle layer 84 is a slow recovery polyurethane having a specific gravity of less than 0.2. Thus, the tongue 80 forms a cushion made of highly compliant foam which compresses during use under pressure applied to the tongue by the laces and foot. Further, the foam has a resiliency capable of restoring the tongue 80 substantially to its initial thickness after the foot is withdrawn from the footwear 20 and pressure is relieved from the tongue. The foam is selected to have a resiliency which restores the tongue 80 to the initial thickness sufficiently slowly that the foot may be withdrawn from the footwear 20 and the tongue may be visually inspected before the resiliency fully restores the tongue to its initial thickness. Preferably, the foam is selected to have a recovery time of between about five and ten seconds, and most preferably a recovery time of about seven seconds. Therefore, the foam provides a visual indication that the tongue 80 effectively cushioned the foot during previous uses and is capable of effectively cushioning the foot during future use. Because the resiliency of the foam deteriorates over time, it eventually permanently collapses so the tongue 80 loses its ability to cushion the foot. With the visual indication described above, the wearer can periodically inspect the tongue 80 to evaluate whether the foam is resilient and whether the footwear should be replaced.

Protrusions 88 extend generally downward from the lower surface of the tongue 80. The protrusions 88 are formed on the inner surface of the foam middle layer 84 of the tongue. The cloth inner layer 86 conforms to the protrusions 88 so they project inwardly into the shoe in a diamond pattern and are visually perceptible. When the shoe is worn, these protrusions 88 compress so the inner surface of the tongue 80 becomes generally flat. When the shoe is removed and pressure is relieved from the inner surface, the resilience of the middle layer 84 returns the protrusions 88 to their initial condition in which they project from an adjacent area of the tongue 80 to indicate the tongue effectively cushioned the foot during prior use and is capable of effectively cushioning the foot during future use. When the resilience of the middle layer 84 has diminished so the tongue 80 no longer returns to its initial thickness, the protrusions 88 cease to project outward from the adjacent areas of the tongue sufficiently to be visually perceptible. Thus, the protrusions 88 aid in discerning whether the tongue 80 has a reduced capability for effectively cushioning the foot. However, in an alternate embodiment (not shown), the protrusions 88 may be omitted entirely so the inner surface of the tongue 80 is flat.

As illustrated in FIG. 4, several sheets of material are positioned between the counter 60 and the rearward lining 66 of the upper 24. A stiff plastic counter element 90 is positioned immediately outside the lining 66 to stiffen the rearward portion of the upper 24. The counter element 90 is sized and shaped so it extends upward past the counter 60, but does not extend horizontally past the forward edges of the counter. Further, the counter element 90 vertically overlaps the rim 46 formed in the midsole 32 so it is retained to the sole 22 to stiffen the rearward portion of the upper 24 to resist bending with respect to the sole of the footwear 20. A felt sheet 92 fills the area immediately outside the counter element 90, and a reinforcement member 94 is adhesively bonded between the felt sheet and the counter 60.

Reinforcement member 94 is separate from the sole 22 and positioned entirely above the midsole rim 46 so it does not vertically overlap the rim, and thus, does not prevent the upper 24 from bending with respect to the sole 22. Rather, the reinforcement member 94 strengthens the counter 60 to prevent it from stretching. In addition, the reinforcement member 94 adds bulk to the counter 60 to give it the appearance of thickness thereby giving the footwear 20 a higher quality appearance. The upper and forward edge margins of the reinforcement member 94 are tapered to gradually increase the apparent thickness of the counter 60 along its corresponding edges. A leather loop 96, formed at the back of the shoe generally above the reinforcement member 94, completes this portion of the footwear construction.

A reinforcement member 98 is also positioned between the lining 64 and the tip 56 of the upper 24. The reinforcement member 98 and tip 56 are bonded to one another so the reinforcement member is positioned entirely above the sole 22. Thus, the outsole rim 40 and reinforcement member 98 do not vertically overlap, and the member is not intended to stiffen the upper 24 against bending with respect to the sole 22. Rather, the member 98 inhibits the tip 56 from bending with respect to itself and strengthens it to prevent it from stretching through use. Further, the reinforcement member 98 gives the tip 56 a thicker, higher quality appearance and helps to retain the foot in position on the sole. The upper and rearward edge margins of the reinforcement member 98 are tapered similarly to the reinforcement member 94 at the rear of the shoe, to give the tip 56 a gradually increasing thickness.

Both reinforcement members 94, 98 are made of EVA foam sheet having a thickness of about 2 millimeters (mm) and a specific gravity of between about 0.15 and about 0.25 . Thus, the members 94, 98 are lightweight. Further, it has been found that foam having a Shore A scale durometer hardness of between about 25 and about 30 provides a good combination of stiffness and flexibility for the reinforcement members 94, 98. Reinforcement members 94, 98 having the configurations and properties described above have been found to sufficiently prevent bending and stretching of the upper 24 to reduce movement between the wearer's foot and sole 22 to retain the foot in position on the sole.

Referring to FIGS. 4 and 5, the removable sockliner 50 of the preferred embodiment is formed from three layers 110, 112, 114 which are adhesively bonded together to form a cushion for placement on top of the sole 22 of the footwear 20. The bottom layer 110 is made of polyurethane foam having a specific gravity of less than about 0.2, and is generally sized and shaped similarly to the wearer's foot as illustrated in FIG. 5. An arch 116 is formed on the medial side of the bottom layer 110 as is conventional in the art so it underlies an arch of a wearer's foot when received in the shoe. Further, as illustrated in FIGS. 4 and 6, a wall 118 formed around the rearward end of the bottom layer 110 forms a heel cup 120 for receiving the heel of the wearer's foot to mold the flesh of the heel into a cushioning position under the os calcis (heel bone) of the wearer's foot. The heel cup 120 extends forward on the lateral side the bottom layer 110 to a position laterally opposite the arch 116. The bottom layer 110 of the preferred embodiment is about 4 mm thick over most of its area, but tapers over the forward most 4 cm to about 2 mm. The wall 118 defining the heel cup 120 is between about 20 and about 25 mm high measured from the bottom of the bottom layer 110.

The middle layer 112 of the sockliner 50 overlies the bottom layer 110 as shown in FIG. 4. This layer 112 is made of a slow recovery polyurethane foam similar to that of the tongue 80 middle layer 84 and is approximately 1 mm thick. The foam is formulated to compress under pressure from a wearer's foot and to recover to its uncompressed thickness in about five to ten seconds after the pressure is removed, and more preferably in about seven seconds after the pressure is removed. This rate is slower than conventional polyurethane used in the bottom layer 110. This enables a wearer to remove the shoe and view the foam liner 50 while it is returning to its initial, uncompressed thickness. Further, the resistance to compression of the slow recovery foam used in the middle layer 112 is less than that of the foam used in the bottom layer 110. The top layer 114 is made of cloth such as Nylex® polymer knit fabric. Nylex is a U.S. federally registered trademark of Toray Industries, Ltd. of Japan.

Diamond shaped protrusions 122 similar to the protrusions 88 on the tongue 80 extend upward from the upper surface of the middle layer 112. These protrusions 122 are rounded on top and extend about 1 mm above the surface of the middle layer 112. The protrusions 122 enhance the wearer's ability to view the middle layer 112 returning to the uncompressed thickness just as the protrusions 88 helped in viewing the tongue 80. More particularly, the protrusions 122 project outward from the adjacent area of the sockliner 50 so as to be visually perceptible when the corresponding region of the sockliner 50 is not compressed, and the sockliner has a cushioning active status. In contrast, the protrusions 122 do not project outward far enough to be visually perceptible when the sockliner 50 has a cushioning inactive status, indicating the footwear 20 and/or sockliner 50 should be replaced. In an alternate embodiment (not shown), the protrusions 122 may be omitted entirely so the upper surface of the sockliner 50 is flat. It is further envisioned that slow recovery polyurethane foam may be used in other locations within the shoe to provide a visual indication of the effectiveness of cushioning. In addition, protrusions may be used on surfaces of the foam at these other locations to enhance the wearer's ability to view the foam returning to its uncompressed thickness.

Figure 7:
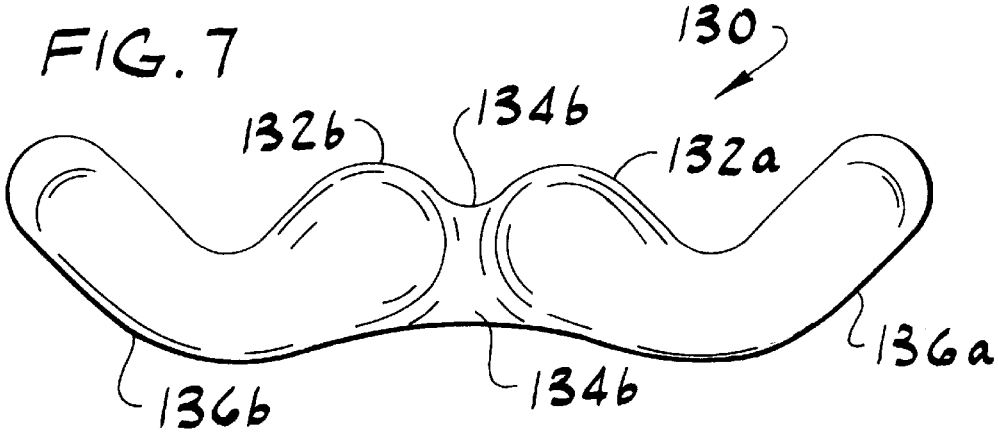
FIG. 7 is an elevation of a collar insert removed from the footwear.
Figure 8:
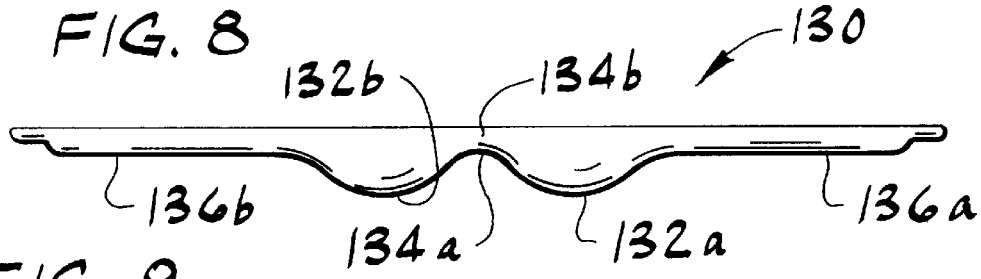
FIG. 8 is a top plan of the collar insert.
Figure 9:
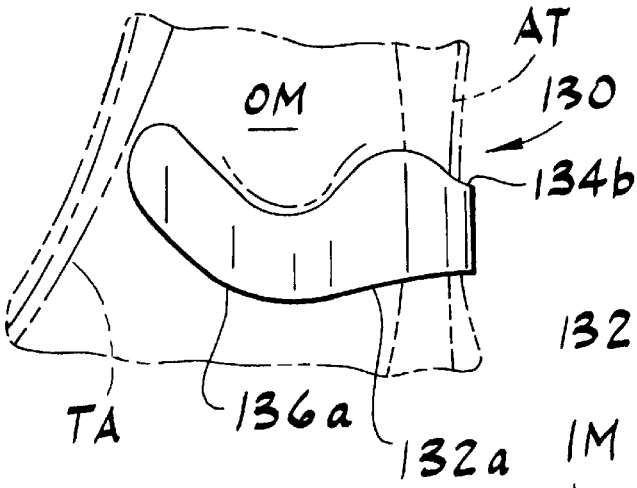
FIG. 9 is a front elevation of the collar insert removed from the footwear and in position around a wearer's ankle.
Figure 10:
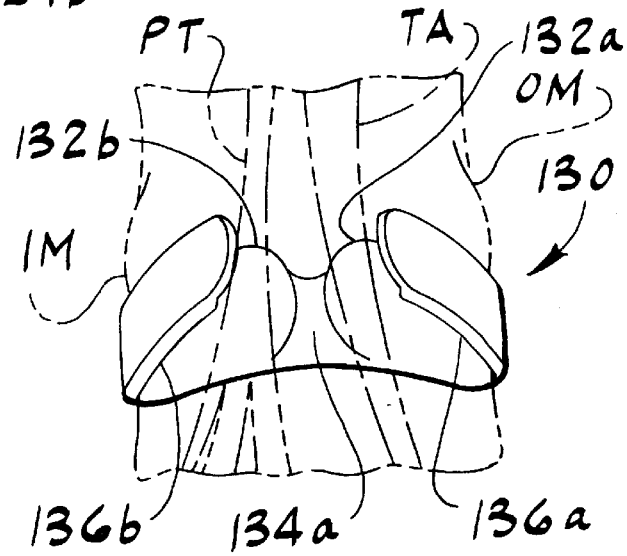
FIG. 10 is a right side elevation of the collar insert removed from the footwear and in position around a wearer's ankle.

As further illustrated in FIG. 4, a foam collar insert, generally designated by 130, is positioned between the outer shell 52 and lining 66 adjacent the collar 62 of the upper 24. The insert 130 is molded as shown in FIGS. 7 and 8 so its outside surface is planar and its inside surface has two lobes 132*a*, 132*b* separated by vertical and horizontal scallops 134*a*, 134*b*, respectively. Further, two arcuate sections 136*a*, 136*b* extend outward from the lobes 132*a*, 132*b*. The thickness of the lobes 132*a*, 132*b* is greater than the thickness of the arcuate sections 136*a*, 136*b* so that the overall shape of the collar insert 130 conforms to the anatomy of the wearer to hold the footwear 20 firmly in place on the foot to minimize motion between the footwear and foot. When the foot is received on the sole 22 of the footwear 20, the collar 130 embraces the ankle of the wearer as shown in FIGS. 9 and 10. To further understand how the collar embraces the ankle, it is necessary to understand some anatomy in the vicinity of the ankle.

An ankle bone extends generally laterally outward from each side of the ankle. More particularly, the portion of the ankle bone protruding from the inner side of the ankle is called an inner malleolus, designated by IM, and the portion protruding from the outer side is called an outer malleolus OM. A tendon known as a tendo achillis AT (or Achilles tendon) extends upward past the ankle from the os calcis (or heel bone) at the rearward end of the foot. Several tendons extend down in front of the lower portion of the tibia (or shin bone) and over the top of the foot. Among these tendons are a tibialis anticus TA which extends upward from the metatarsal bone of the big toe past the front of the inner malleolus IM and a peroneus tertius PT which extends upward from the toes past the front of the outer malleolus OM. These tendons generally contract as the foot is flexed upward. Below the outer and inner malleoli OM and IM, respectively, the foots tapers outward generally in all directions.

When the foot is received on the sole 22 of the footwear, the lobes 132*a*, 132*b* are arranged as illustrated in FIGS. 9 and 10 such that one lobe 132*a* is positioned between the outer malleolus OM and the tendo achillis AT and the other lobe 132*b* is positioned between the tendo achillis AT and the inner malleolus IM. Further, the arcuate sections 136*a*, 136*b* extend downward and forward from the respective lobes so that they curve around the lower sides of the outer and inner malleolus OM, IM, respectively. Thus, the lobes 132*a*, 132*b* fill the hollows of the ankle behind the inner and outer malleolus and the arcuate sections 136*a*, 136*b* conform to the areas of the ankle below and in front of these bones to evenly distribute the pressure of the collar around the ankle. Accordingly, the collar insert 130 engages the foot over a substantial area of the collar 62 so that the collar grips the ankle to inhibit relative motion between the foot and the footwear 20 as the footwear is flexed by the foot.

It will also be noted that the scallops 134*a*, 134*b* overlie the tendo achillis AT so the collar 62 does not apply significantly greater pressure to the tendo achillis than to the rest of the ankle. Thus, the collar 62 avoids complications associated with greater pressure as previously explained. Further, the forward ends of the arcuate sections 136*a*, 136*b* are positioned so they are entirely behind the peroneus tertius PT and the tibialis anticus TA and do not interfere with the functioning of these tendons. Moreover, as shown in FIGS. 7 and 8, the arcuate sections 136*a*, 136*b* are longer in a circumferential direction measured around the wearer's ankle than the lobes 132*a*, 132*b* to conform to the shape of the ankle as previously described. Further, it is envisioned that the lobe 132*a* on the medial side of the ankle may be shorter than the lobe 132*b* on the lateral side of the ankle to more closely conform to the shapes of the corresponding hollows. The collar insert 130 is preferably made of an easily compressible foam such as the slow recovery polyurethane previously described with respect to the tongue and sockliner.

The footwear 20 of the present invention is manufactured in a conventional manner which is well-known in the art. Generally, the various components of the upper 24 are sewn and/or glued together. The assembled upper 24 and the insole liner 34 are sewn together before the insole liner 34, midsole 32 and outsole 30 are bonded together using a conventional adhesive.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A cushion for use inside footwear having an interior for receiving a foot of a wearer, the cushion comprising:

a liner made of cushioning material sized and shaped for reception on a sole of the footwear in a position for engaging the foot when the foot is inserted into the interior of the footwear for cushioning an interface between the foot and the sole, the liner including a visual cushioning indicator for visually indicating the operability of the cushion to perform a cushioning function during an immediately prior use by the wearer and for subsequent use, the visual cushioning indicator comprising:

at least one protrusion projecting upward from a surface of the liner as received on the sole of the footwear, the protrusion having a cushioning active status in which the protrusion projects visually perceptibly outward from an adjacent area of the liner in an uncompressed state when the region of the liner including the protrusion is not compressed and in which the protrusion generally conforms to the shape of the adjacent area of the liner in a compressed state when the region including the protrusion is compressed so as not to project visually perceptibly outward from the adjacent area, the protrusion further having a cushioning inactive status in which the protrusion does not project visually perceptibly outward from the adjacent area in either of the compressed and uncompressed states of the region of the liner including the protrusion, and a first layer of slow recovery foam having an uncompressed thickness and capable of being compressed in a region engaged by the foot to a compressed thickness which is less than the uncompressed thickness, said first layer being constructed to return the compressed region from the compressed thickness substantially to the uncompressed thickness at a rate selected to permit the wearer to remove the footwear from the foot and visually inspect the region returning substantially to the uncompressed thickness thereby to visually indicate that the cushion is functioning to cushion the foot with the sole of the footwear;

a cloth sheet overlying said first layer as received on the sole of the footwear; and a second layer of foam underlying said first layer as received on the sole of the footwear, said second layer having an uncompressed thickness and capable of being compressed in a region engaged by the foot to a compressed thickness which is less than the uncompressed thickness, said second layer of foam being constructed to return the compressed region from the compressed thickness substantially to the uncompressed thickness at a faster rate than that of said first layer.

2. A cushion as set forth in claim 1 wherein said first layer has less resistance to compression than said second layer.

3. A cushion as set forth in claim 2 wherein the cushion is a sockliner for removable reception over the sole of the footwear.

4. A cushion as set forth in claim 3 wherein the sockliner includes an arch along a medial side of the sockliner for supporting a medial portion of the foot and a wall defining a heel cup extending rearward from the arch, around a rearward end of the sockliner and forward to a lateral side of the sockliner opposite the medial side for receiving a heel of the foot of the wearer to mold flesh of the heel into a cushioning position under a heel bone of the wearer.

5. A cushion for use inside footwear having an interior for receiving a foot of a wearer, the cushion comprising a liner made of cushioning material sized for reception on an interior surface of the footwear in a position for engaging the foot when the foot is inserted into the interior of the footwear for cushioning an interface between the foot and the interior surface of the footwear with which the liner is engaged, the liner including a visual cushioning indicator for visually indicating the operability of the cushion to perform a cushioning function during an immediately prior use by the wearer and for subsequent use, the visual cushioning indicator comprising at least one protrusion formed in a surface of the liner, the protrusion having a cushioning active status in which the protrusion projects visually perceptibly outward from an adjacent area of the liner in an uncompressed state when the region of the liner including the protrusion is not compressed and in which the protrusion generally conforms to the shape of the adjacent area of the liner in a compressed state when the region including the protrusion is compressed so as not to project visually perceptibly outward from the adjacent area, the protrusion further having a cushioning inactive status in which the protrusion does not project visually perceptibly outward from the adjacent area in either of the compressed and uncompressed states of the region of the liner including the protrusion, wherein the cushion is sized and shaped for reception on an inside surface of a tongue of the footwear so that the protrusions project generally downward as received on the tongue of the footwear.

6. A cushion as set forth in claim 5 further comprising a cloth sheet underlying the layer as received on the tongue of the footwear.

7. A cushion for use inside footwear having an interior for receiving a foot of a wearer, the cushion comprising a liner made of cushioning material sized for reception on an interior surface of the footwear in a position for engaging the foot when the foot is inserted into the interior of the footwear for cushioning an interface between the foot and the interior surface of the footwear with which the liner is engaged, the liner including a visual cushioning indicator for visually indicating the operability of the cushion to perform a cushioning function during an immediately prior use by the wearer and for subsequent use, the visual cushioning indicator comprising at least one protrusion formed in a surface of the liner, the protrusion having a cushioning active status in which the protrusion projects visually perceptibly outward from an adjacent area of the liner in an uncompressed state when the region of the liner including the protrusion is not compressed and in which the protrusion generally conforms to the shape of the adjacent area of the liner in a compressed state when the region including the protrusion is compressed so as not to project visually perceptibly outward from the adjacent area, the protrusion further having a cushioning inactive status in which the protrusion does not project visually perceptibly outward from the adjacent area in either of the compressed and uncompressed states of the region of the liner including the protrusion, wherein the layer of slow recovery foam is constructed to return the compressed region from the compressed thickness substantially to the uncompressed thickness in about five to about ten seconds after the foot is removed from the interior of the footwear.

8. A cushion for use inside footwear to provide cushioning to a foot received within the footwear, the cushion comprising:

a first layer made of compliant slow recovery foam having an initial thickness prior to use and a compressed thickness thinner than said initial thickness during use resulting from pressure applied to the cushion by the foot, said slow recovery foam being sized for reception on an interior surface of the footwear and having a resiliency capable of restoring the cushion substantially to said initial thickness after the foot is withdrawn from the footwear and pressure is relieved from the cushion, the resiliency of said slow recovery foam being selected to restore the cushion to said initial thickness sufficiently slowly that the foot may be withdrawn from the footwear and the cushion may be visually inspected before the resiliency fully restores the cushion to said initial thickness thereby providing a visual indication that the cushion effectively cushioned the foot during prior use and is capable of effectively cushioning the foot during future use, said first layer of slow recovery foam including at least one protrusion formed in a surface of said first layer, the protrusion protecting visually perceptibly outward from an adjacent area of said first layer when the protrusion and adjacent area are not compressed to indicate that the cushion effectively cushioned the foot during prior use and is capable of effectively cushioning the foot during future use and not protecting visually perceptibly outward from the adjacent area of said first laver when the protrusion and adjacent area are not compressed to indicate that the cushion has a reduced capability of effectively cushioning the foot during future use, wherein the cushion is sized and shaped for reception on a sole of the footwear so that the protrusions project upward as received on the sole of the footwear;

a cloth sheet overlying said first layer as received on the sole of the footwear; and a second layer of foam underlying said first layer as received on the sole of the footwear, said second layer having an uncompressed thickness and being capable of being compressed in a region engaged by the foot to a compressed thickness which is less than the uncompressed thickness, said second layer being constructed to return the compressed region from the compressed thickness substantially to the uncompressed thickness at a faster rate than said first layer.

9. A cushion as set forth in claim 8 wherein said first layer has less resistance to compression than said second layer.

10. A cushion as set forth in claim 9 wherein the cushion is a sockliner for removable reception on the sole of the footwear.

11. A cushion as set forth in claim 10 wherein the sockliner includes an arch along a medial side of the sockliner for supporting a medial portion of the foot and a wall defining a heel cup extending rearward from the arch, around a rearward end of the sockliner and forward to a lateral side of the sockliner opposite the medial side for receiving a heel of the foot of the wearer to mold flesh of the heel into a cushioning position under a heel bone of the wearer.

12. A cushion for use inside footwear to provide cushioning to a foot received within the footwear, the cushion comprising a layer made of compliant slow recovery foam having an initial thickness prior to use and a compressed thickness thinner than said initial thickness during use resulting from pressure applied to the cushion by the foot, the foam being sized for reception on an interior surface of the footwear and having a resiliency capable of restoring the cushion substantially to said initial thickness after the foot is withdrawn from the footwear and pressure is relieved from the cushion, the resiliency of the foam being selected to restore the cushion to said initial thickness sufficiently slowly that the foot may be withdrawn from the footwear and the cushion may be visually inspected before the resiliency fully restores the cushion to said initial thickness thereby providing a visual indication that the cushion effectively cushioned the foot during prior use and is capable of effectively cushioning the foot during future use, wherein the layer of slow recovery foam includes at least one protrusion formed in a surface of the layer, the protrusion projecting visually perceptibly outward from an adjacent area of the layer when the protrusion and adjacent area are not compressed to indicate that the cushion effectively cushioned the foot during prior use and is capable of effectively cushioning the foot during future use and not protecting visually perceptibly outward from the adjacent area of the layer when the protrusion and adjacent area are not compressed to indicate that the cushion has a reduced capability of effectively cushioning the foot during future use, and wherein the cushion is sized and shaped for reception on an inside surface of a tongue of the footwear so that the protrusions project generally downward as received on the tongue of the footwear.

* * * * *